US006015005A

United States Patent [19]

Durchenwald

[11] Patent Number: 6,015,005

[45] Date of Patent: Jan. 18, 2000

[54] RESPECTIVE INFLATABLE ARBORS FOR MAKING BACKDRAFT CAVITY IN SAND CORE AND FOR FORMING PART OF CORE LIFT DEVICE INSERTABLE IN CAVITY

[75] Inventor: Larry Don Durchenwald, Cedar Falls, Iowa

[73] Assignee: Deere Company, Moline, Ill.

[21] Appl. No.: 08/936,773

[22] Filed: Sep. 24, 1997

[51] Int. Cl.[7] ..... B22C 9/10; B22C 23/00

[52] U.S. Cl. ..... 164/170; 164/171; 164/186; 164/412; 249/179; 269/22; 269/48.1; 294/98.1

[58] Field of Search ..... 164/412, 401, 164/170, 171, 186, 213, 228; 249/65, 178, 179; 269/22, 48.1; 294/98.1

[56] References Cited

U.S. PATENT DOCUMENTS

| | | | |
|---|---|---|---|
| 2,877,521 | 3/1959 | Tallone | 164/171 |
| 3,166,335 | 1/1965 | Mason | 294/48.1 X |
| 4,811,962 | 3/1989 | Cameron, Jr. | 269/22 X |
| 4,915,157 | 4/1990 | Durchenwald | 164/412 |
| 5,090,758 | 2/1992 | Lord | 294/98.1 |

FOREIGN PATENT DOCUMENTS

| | | | |
|---|---|---|---|
| 74964 | 11/1952 | Denmark | 294/98.1 |
| 0161750 | 11/1985 | European Pat. Off. | 294/98.1 |
| 527222 | 6/1931 | Germany | 164/170 |
| 288780 | 4/1991 | Germany | 269/48.1 |
| 63-33146 | 2/1988 | Japan | 164/228 |
| 6-8179 | 1/1994 | Japan | 294/98.1 |

*Primary Examiner*—J. Reed Batten, Jr.

[57] ABSTRACT

Tooling includes an inflatable arbor for forming a backdraft cavity in a foundry sand core. A core handling device includes an inflatable arbor, similar to the one used for forming the backdraft cavity in the sand core, whereby the lifting device arbor, when in its deflated state, may be inserted into the backdraft cavity of the sand core and then inflated to grip and become locked to the sand core.

4 Claims, 4 Drawing Sheets

RESPECTIVE INFLATABLE ARBORS FOR MAKING BACKDRAFT CAVITY IN SAND CORE AND FOR FORMING PART OF CORE LIFT DEVICE INSERTABLE IN CAVITY

BACKGROUND OF THE INVENTION

The present invention relates to a system for handling foundry sand cores and more specifically relates to such systems which include tooling for forming cavities or receptacles in sand cores, and lifting devices including inflatable arbors for being inserted in and expanded against the wall of the cavity previously formed in the sand core.

In order to improve the finish on casting surfaces, foundry sand cores are often coated or washed with a refractory slurry which is then dried onto the core surface. One way of applying the wash to the core is by dipping the core in a vat containing the slurry. Movement of these cores to and from the vat and into position for entering a drying oven is often accomplished by lifting devices or hoists having at least one arbor insertable into a hole formed in the sand core by a tapered pin located in the corebox when the loose core material is being blown into the corebox. The arbor is of a type including an expandable urethane cylinder which is selectively inflated to swell out against the walls of the hole. Thus, friction is the means for retaining the core on the arbor. Pull tests have shown this method of retention to be variable in effectiveness. For example, the capacity for holding the core on the arbor is diminished when the surface of the wall of the hole is wet, as is often the case when a core wash has been applied to the surface of the core.

U.S. Pat. No. 4,915,157 granted to Durchenwald on Apr. 10, 1990 discloses a core handling device equipped with one or more arbors constructed with an expandable urethane cylinder, as described.

SUMMARY OF THE INVENTION

According to the present invention there is provided an improved foundry sand core handling system of the type including tooling, used with the corebox for forming one or more cavities or receptacles in the core, and a lift device incorporating one or more expandable arbors, each insertable into a respective void or receptacle provided in the core.

An object of the invention is to provide a sand core handling system including selectively expandable tooling for use with a corebox for forming one or more cavities having backdraft in a sand core and to provide a lift hoist having one or more arbors, constructed in a manner similar to such tooling, for being inserted in said cavities and expanded to grip the core for handling.

Yet a more specific object of the invention is to provide a sand core handling system, as described in the previous object, wherein the corebox tooling and lift device each include one or more arbors, with each arbor being constructed to include a cylindrical bladder which is inflatable to a barrel shape, the tooling being positioned in a corebox and the arbor inflated prior to core sand being blown, or otherwise introduced, into the corebox and then deflated to permit it to be withdrawn from the core so as to leave a barrel-shaped cavity, i.e., a cavity having backdraft, for receiving the inflatable cylinder of the lift device arbor.

These and other objects will be apparent from a reading of the ensuing description together with the appended drawings.

DESCRIPTION OF THE PREFERRED EMBODIMENT

Figure 1:
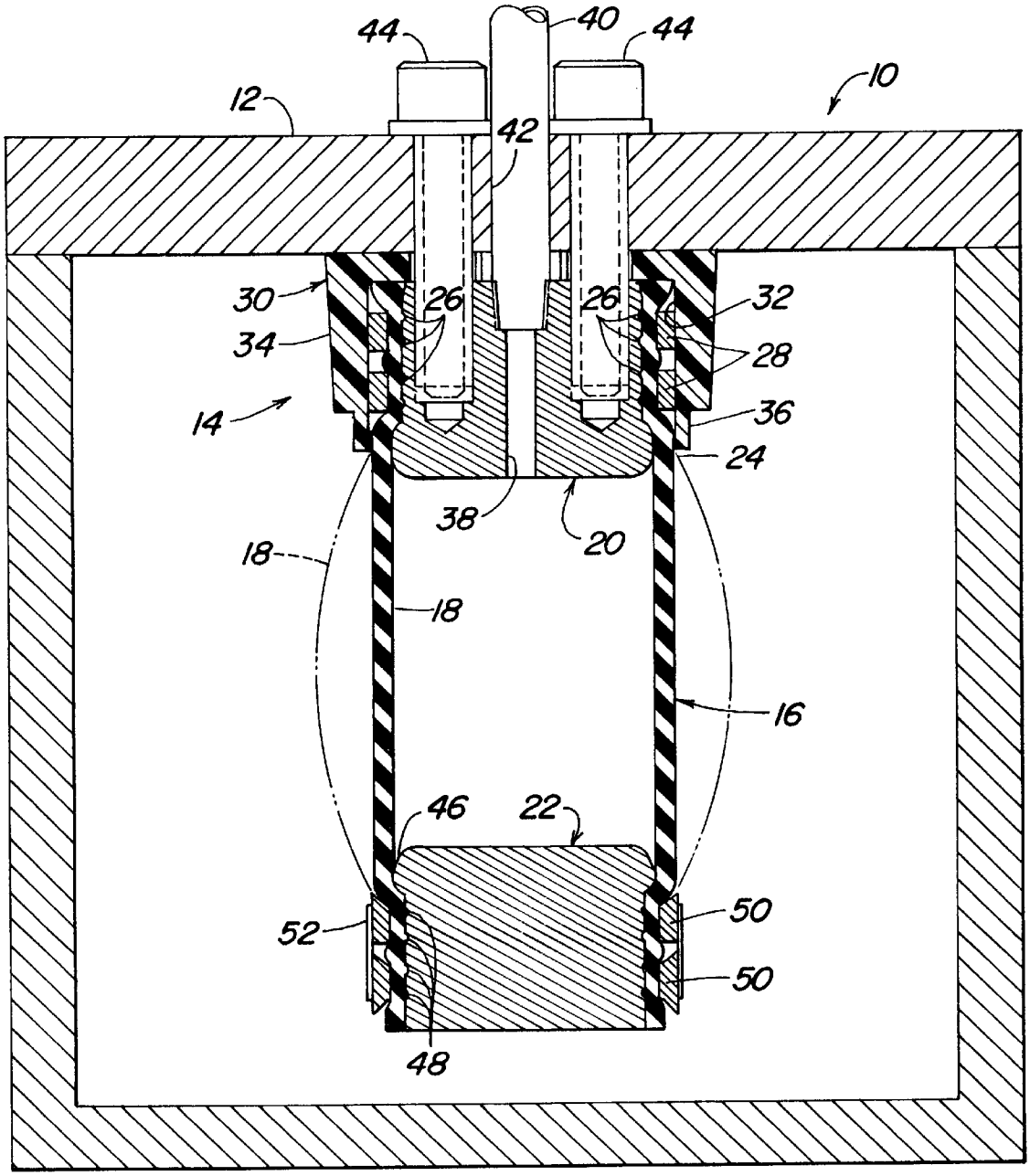
FIG. 1 is a vertical sectional view showing backdraft tooling including an arbor having an inflatable cylinder positioned in a foundry corebox prior to being inflated and prior to core sand being blown, or otherwise placed, into the corebox.

Referring now to FIG. 1, there is shown a corebox 10 having a top wall 12 supporting backdraft tooling 14. The tooling 14 includes an arbor comprising an inflatable cylinder 16 formed from a resilient, expandable cylindrical tube or sleeve 18 constructed of urethane or reinforced woven rubber material, for example. Top and bottom cylindrical plugs 20 and 22, respectively, are received in upper and lower end portions of the tube 18. The top plug 20 has an upper end disposed flush with an upper end of the tube 18 and has an enlarged lower end portion 24 having a diameter substantially equal to an inner diameter of the tube. Spaced along the exterior of the top plug 20 from its upper end to the lower end portion 24 are a plurality of annular grooves 26. Encircling an upper length of the tube 18 located above the plug end portion 24 is a pair of crimp rings or bands 28 tightened so as to compress the tube such that it fills the annular grooves 26 to make a tight seal. A cap 30, made of ultra high molecular weight plastic, forms a top of the cylinder 16. The cap 30 includes a cylindrical inner wall 32 engaged with the crimp rings or bands 28 and includes an outer wall including a major conical upper section 34, which tapers slightly downwardly and inwardly, and an inwardly stepped lower cylindrical section 36 which extends from a point even with a bottom of the lower crimp band 28 to a point approximately even with a mid-length location of the plug end portion 24. The tapered upper section 34 of the outer wall permits easy withdrawal of the tooling from the sand core. An axial bore 38 is provided in the top plug 20 to provide an inlet to the cylinder 16. An upper end of the bore 38 is threaded and a pressure fluid supply conduit 40 has a lower threaded end coupled to the bore 38. A hole 42 is provided in the top wall 12 of the corebox 10, with the conduit 40 extending through the hole. The upper end of the cylinder 16 is secured to the upper wall 12 by a pair of stud bolts 44 extending through wall and having lower ends threaded into threaded blind bores provided in the top of the plug 20.

The bottom plug 22 is located within the lower end portion of the sleeve 18 with its lower surface being flush with the lower end of the plug 22. Like the lower end portion 24 of the upper plug 20, the lower plug 22 has an upper enlarged end portion 46 having a diameter substantially equal to the inner diameter of the sleeve 18. A plurality of annular grooves 48 are located along the plug 22 below the end portion 46. A pair of flanged crimp rings or bands 50 encircle the sleeve 18 in a zone below the end portion 46 of the plug 22 and are tightened so as to compress the sleeve 18 into the grooves 48 so as to form a fluid tight seal. The joint between the bands 50 are taped, as at 52, so as to prevent sand from entering between the bands and to present a smooth surface for easy withdrawal from the sand core.

Figure 2:
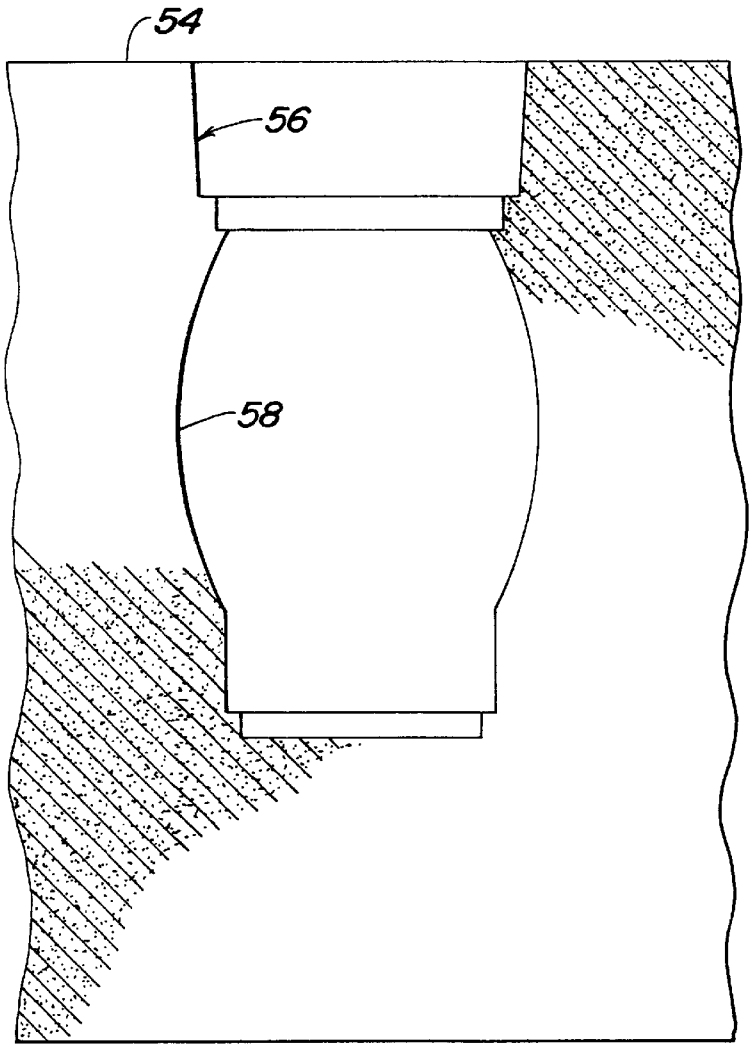
FIG. 2 is a vertical sectional view through a backdraft cavity formed in the core by the tooling shown in FIG. 1.

Thus, it will be appreciated that before sand is introduced into the corebox 10, the cylinder 16 is inflated to the dashed line positioned shown by routing pressure fluid to the cylinder 16 by way of the conduit 40. Referring now to FIG. 2, there is shown a sand core 54 containing a cavity 56 which is formed by ramming core sand into the corebox 10 while the cylinder 16 is inflated and then withdrawing the tooling 14 from the corebox. The cavity 56 reflects the shape of the cylinder cap 30 and inflated sleeve 18 and, as such, includes a barrel-shaped section 58 having an upper half which forms a backdraft.

Figure 3:
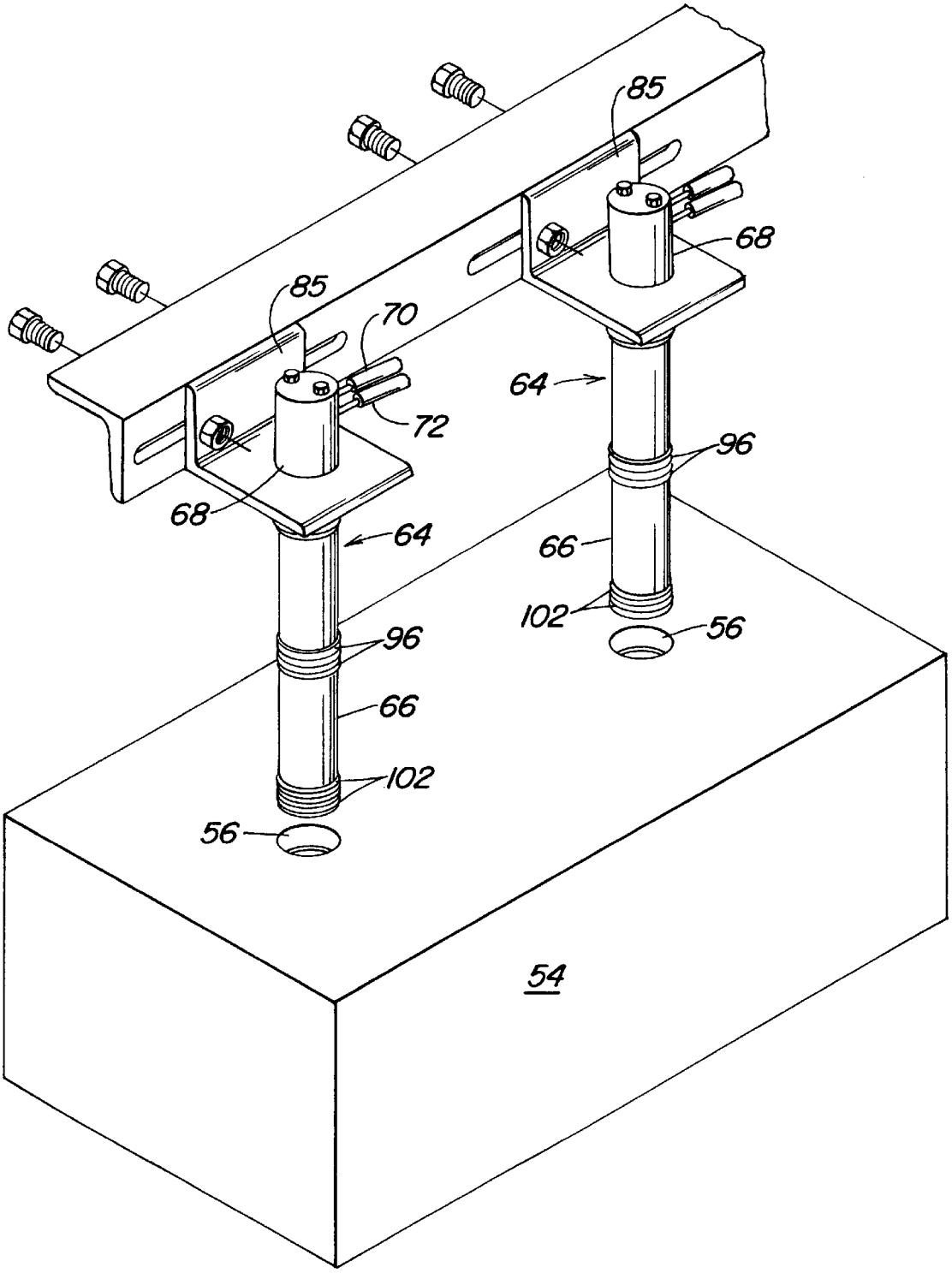
FIG. 3 is a perspective view of a core containing two backdraft cavities and a lifting tool having a pair of arbors having inflatable cylinders positioned for entering the cavities.

Referring now to FIG. 3, there is shown the sand core 54 containing a pair of cavities 56. A support arm 62 of a core-handling device is shown supporting a pair of lift arbors 64, each including a cylindrical sleeve 66 identical to the sleeve 18 of the inflatable arbor 16 of the backdraft tooling 14. The pair of lift arbors 64 are respectively located for being lowered vertically into the pair of cavities 56. A fluid manifold 68 is fixed to the upper end of each arbor 64 and includes porting for routing fluid to and from the interior of the sleeve 66 by way of supply and return fittings 70 and 72 connected to respective ports of a control valve (not shown).

Figure 5:
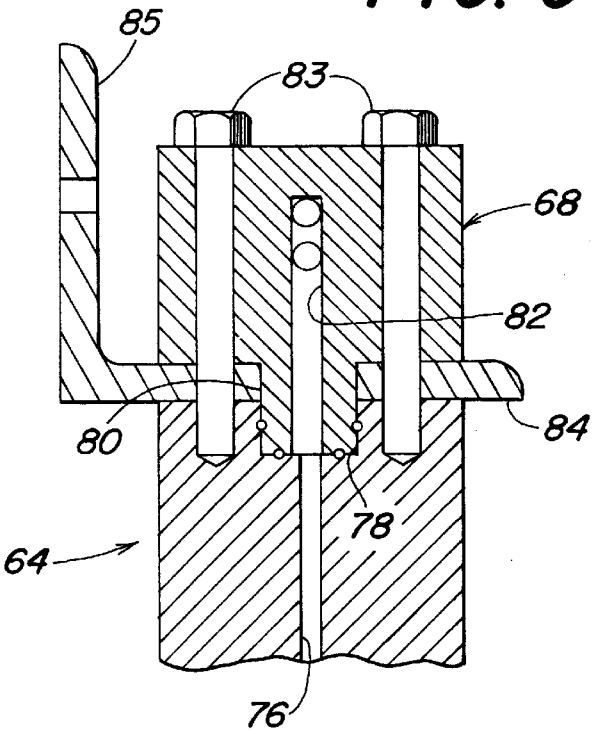
FIG. 5 is a vertical sectional view showing the upper portion of one of the lifting tool arbors illustrated in FIG. 3 and its connection with the bracket supporting the arbor.
Figure 4:
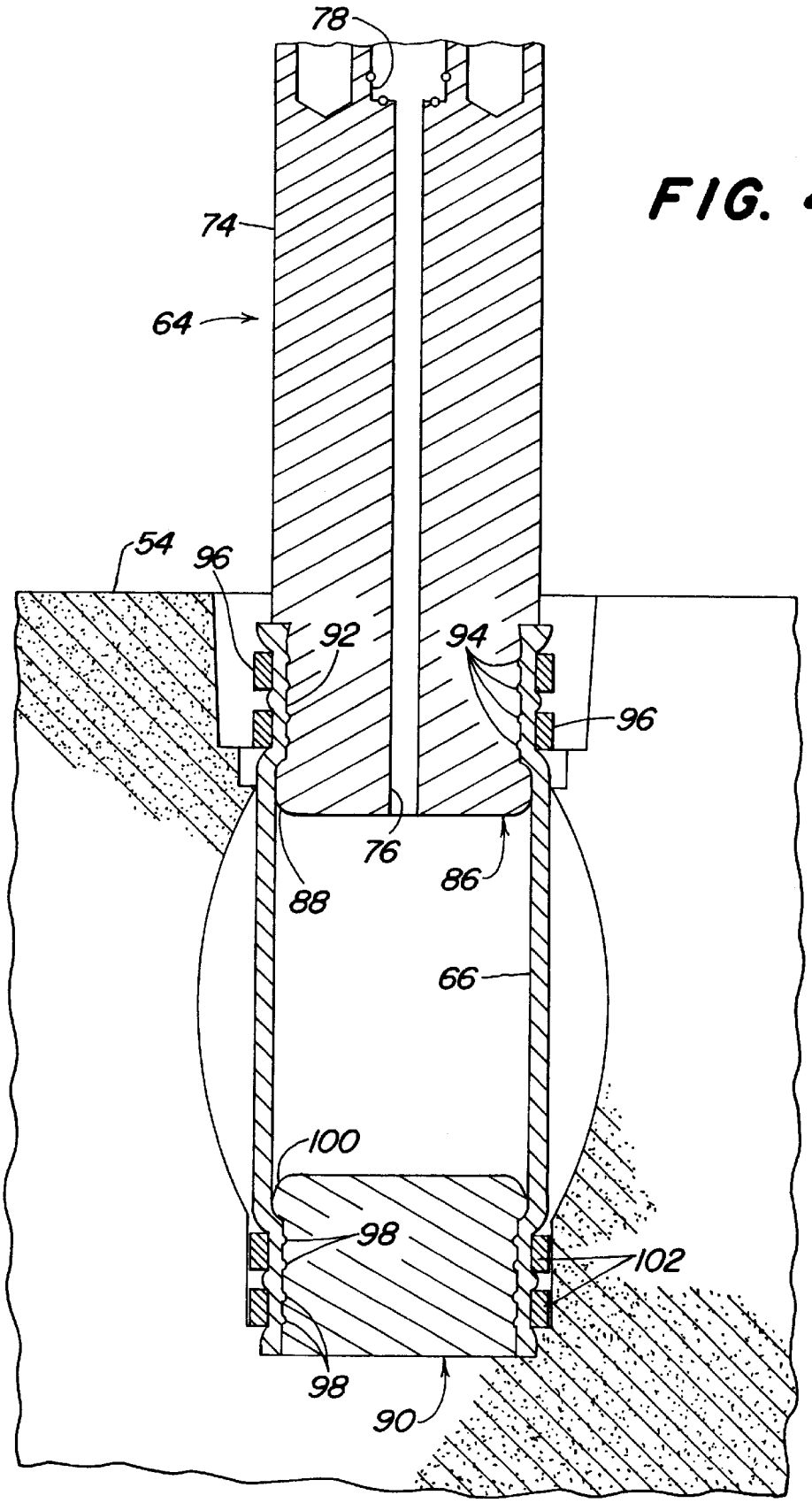
FIG. 4 is a vertical sectional view showing the inflatable cylinder of a lift device arbor positioned in the backdraft cavity created by the inflatable cylinder of the arbor of the backdraft tooling shown in FIG. 1.

Specifically, referring now also to FIGS. 4 and 5, it can be seen that each lift arbor 64 includes an elongate cylindrical support member 74 having a bore 76 extending axially therethrough and in alignment with a counterbore 78 formed in the top of the member 74 and into which a cylindrical projection 80, formed on the bottom of the manifold 68 is received, the manifold containing a bore 82 coupled in fluid communication with the fittings 70 and 72 and with the bore 76 in the member 74. Suitable o-rings are provided for preventing leakage about the projection 80. A pair of cap screws 83 extend through a horizontal leg 84 of an L-shaped mounting bracket 85 and are threaded into threaded blind bores provided in the top of the support member 74.

A lower end section of the support member 74 defines an upper plug 86 inserted into a top end section of the sleeve 66 by a distance equal to the length of the top plug 20 of the cylinder 16 of the backdraft tooling 14, the plug 86 having an enlarged lower end 88 having an outer diameter equal to the inside diameter of the sleeve 66. Closing the bottom of the sleeve 66 is a bottom plug 90, like the bottom plug 22 of the cylinder 16, which is inserted into a lower end section of the sleeve 66 so that a lower end of the plug 90 is flush with a lower end of the sleeve. That part of the upper plug 86 extending between its enlarged lower end 88 and the remainder of the member 74 forms an annular recess 92 located entirely within the top section of the sleeve 66 and having annular grooves 94 at locations spaced axially therealong. An upper pair of crimp rings or bands 96 encircle the upper end section of the sleeve 66 and compress it against the plug 86 and into the grooves 94. The bottom plug 90 includes a plurality of annular grooves 98 located therein below an enlarged upper end 100 of the plug. A lower pair of crimp rings or bands 102 encircle and compress the lower end section of the sleeve 66 against the exterior of the plug 90 and into the grooves 98.

Thus, with reference once again to FIGS. 2 and 3, it will be appreciated that if it is desired to move the sand core 54, it is necessary only to lower the lift arbors 64 to the respective bottoms of the cavities 56 and to then inflate the sleeves 66 so that they expand and engage the barrel-shaped sections 58 of the cavities 56. Due to the backdraft nature of the upper halves of the sections 58, the arbors 64 are "locked" onto the core 54 so that it may be lifted and maneuvered without coming loose from the arbors. When it is desired to remove the arbors 64 from the core 54, it is necessary only to deflate the sleeves 66 so that they return to their normal cylindrical shape which permits their easy withdrawal from the cavities 56.

I claim:

1. In a system for preparing a foundry sand core and for handling the sand core thus prepared, said system including tooling for forming at least one cavity in the sand core and a lifting device having at least one expandable arbor shaped for entering said cavity, when not expanded, and gripping the walls of the cavity when inflated, the improvement comprising: said tooling being shaped for forming a cavity having backdraft and said arbor being inflatable and being shaped for easily entering said cavity when deflated and for tightly engaging said cavity having backdraft when inflated while in said cavity to thereby lock the lifting device arbor to the core.

2. The system defined in claim 1 wherein said tooling for forming at least one cavity in the sand core includes an inflatable second arbor of a construction similar to said first mentioned arbor whereby said second arbor may be positioned in a corebox and inflated prior to core sand being rammed into the corebox and then deflated and removed after core sand has been rammed thereabout to thus form said cavity having backdraft.

3. The system defined in claim 2 wherein each of the arbors includes an elastomeric sleeve which is normally cylindrical and into which pressurized fluid is routed for inflating the same, the sleeve having a barrel-shaped section when inflated, whereby said one cavity includes a similar barrel-shaped section, with half this section having backdraft.

4. The system defined in claim 3 wherein each sleeve includes first and second plugs respectively inserted into first and second ends thereof; and first and second clamp means respectively encircling opposite end sections of each sleeve and holding these end sections in tight engagement with the first and second plugs.

* * * * *